United States Patent [19]

Harrison et al.

[11] 4,038,921

[45] Aug. 2, 1977

[54] MEANS TO CONNECT PRINTING PRESSES IN TANDEM

[75] Inventors: Henry Harrison, Locust Valley; Clement R. Konars, Glen Cove, both of N.Y.

[73] Assignee: Halm Instrument Co., Inc., Glen Head, N.Y.

[21] Appl. No.: 681,265

[22] Filed: Apr. 28, 1976

[51] Int. Cl.[2] ..... B41J 13/08

[52] U.S. Cl. ..... 101/232; 101/183

[58] Field of Search ..... 101/232, 183, 184; 271/4, 34, 275

[56] References Cited

U.S. PATENT DOCUMENTS

| | | | |
|---|---|---|---|
| 353,556 | 11/1886 | Goss et al. | 101/183 |
| 3,485,489 | 12/1969 | Lindquist | 271/34 X |
| 3,768,803 | 10/1973 | Stange | 271/34 |
| 3,944,209 | 3/1976 | Fallos | 271/34 |

*Primary Examiner*—J. Reed Fisher
*Attorney, Agent, or Firm*—James P. Malone

[57] ABSTRACT

Connecting means to connect first and second printing presses in tandem. A support member is mounted on a first printing press. A curved plate is mounted on said support member, said plate bridging the gap between an output of the first printing press and the input of a second printing press.

An endless belt is mounted on said support member over said curved plate and runs in contact with said curved plate. One of the printing presses is connected to drive the belt the same linear speed as the linear paper feed speed of the printing presses.

1 Claim, 5 Drawing Figures

FIG 4
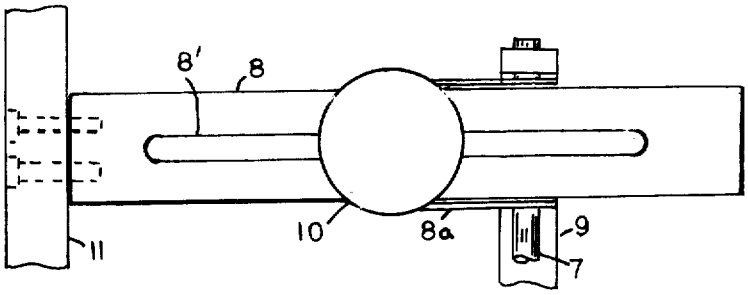
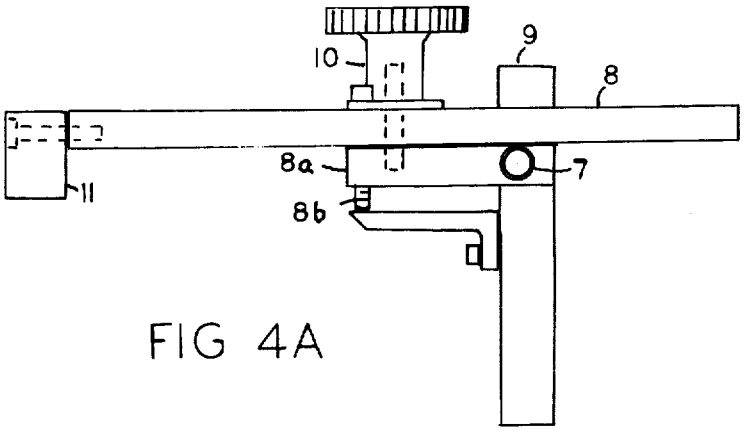
FIG 4A

MEANS TO CONNECT PRINTING PRESSES IN TANDEM

This invention relates to means to connect printing presses in tandem and more particularly to paper feeding means to feed papers from the output of a first printing to the input of a second printing press.

Quite often printing papers on two different presses is required. For instance, documents which are serially numbered are generally printed on one press and numbered on a separate press. If the two printing presses are physically separated the papers must be physically moved in batches from one printing press to the other. If the two presses can be connected in tandem this extra handling would be avoided and the work proceeds continuously rather than in batches. This would greatly increase the efficiency of the printing presses and the manpower used. Also, the starting and stopping of machines and the adjustments required thereby, would be eliminated.

The present invention solves this problem by providing a paper feeding means which directly transmits the paper from a first printing press to the second printing press. The device generally comprises a frame pivotally mounted on one of the printing presses. The presses may be bolted or otherwise connected together. A curved plate mounted on the frame bridges the gap between the output of the first printing press and the input of the second printing press. An endless belt is drivably mounted so that it runs in contact with the curved plate and carries the papers from the first printing press to the second printing press, over the curved plate.

Accordingly, a principal object of the invention is to provide new and improved means to connect printing presses in tandem.

Another object of the invention is to provide new and improved means to connect printing presses in tandem comprising a paper feeding means to feed papers from the output of one printing press to the input of a second printing press.

Another object of the invention is to provide new and improved means to connect printing presses in tandem comprising a paper feeding means to feed papers from the output of one printing press to the input of a second printing press comprising a curved plate bridging the gap between the two printing presses and a driven endless belt mounted on top of the plate and running in contact with the plate so that the papers are fed between the plate and belt.

Another object of the invention is to provide new and improved means for feeding papers between printing presses which are easily removable so that the press may be operated separately with a minimum delay.

Another object of the invention is to provide new and improved means for feeding papers between first and second printing presses in tandem comprising, a support member mounted on a first printing press of the printing presses, a curved plate mounted on said support member, said plate bridging the gap between an output of the first printing press and the input of a second printing press, an endless belt mounted on said support member over said curved plate and running in contact with said curved plate, means connected to one of the printing presses to drive the belt the same linear speed as the linear paper feed speed of the printing presses.

These and other objects of the invention will be apparent from the following specification and drawings of which:

FIG. 4 is a side detail view of the slide mechanism.

FIG. 4A is a top view of FIG. 4.

Figure 1:
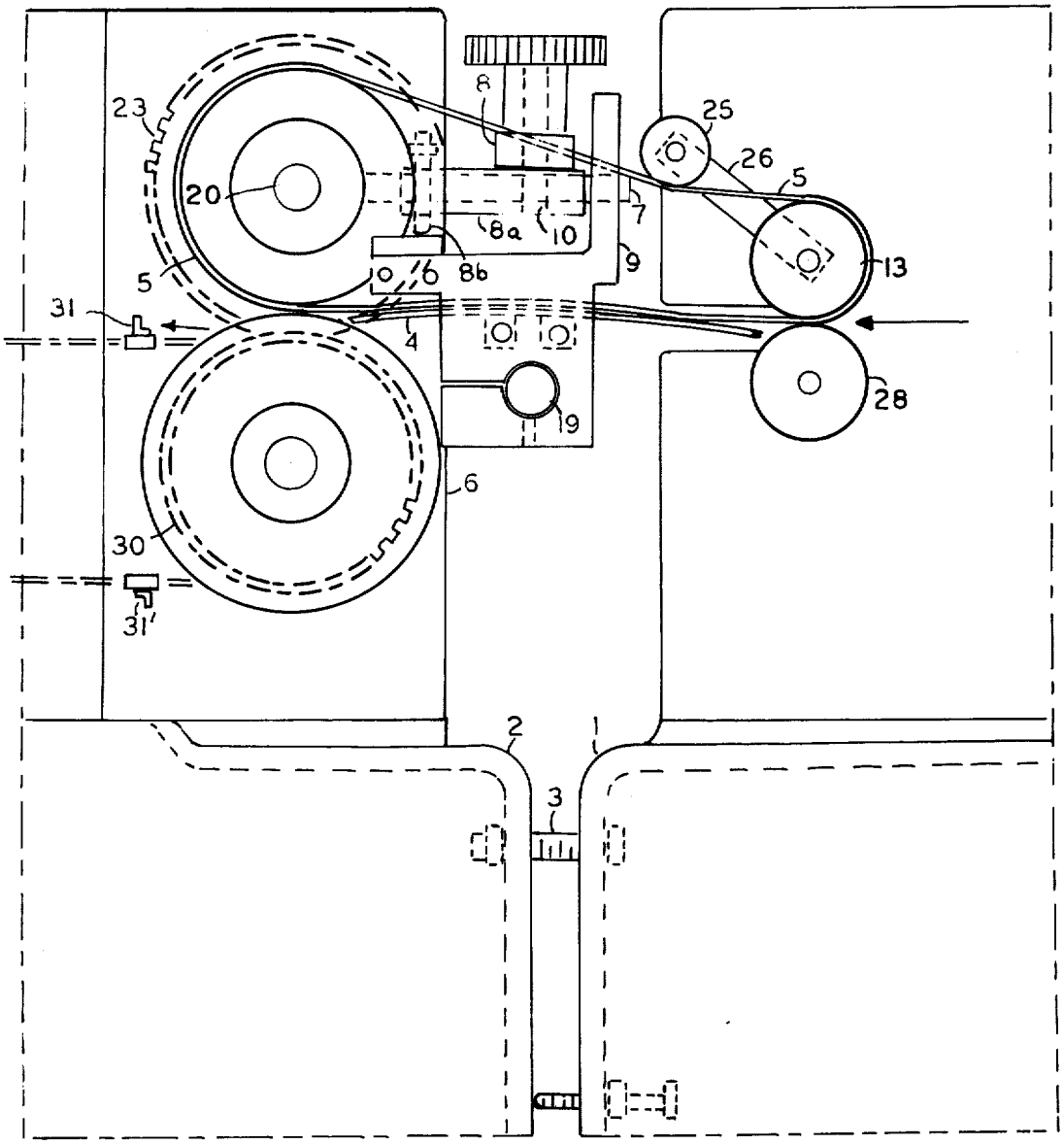
FIG. 1 is a side view of the embodiment of the invention, with the side covers removed.
Figure 2:
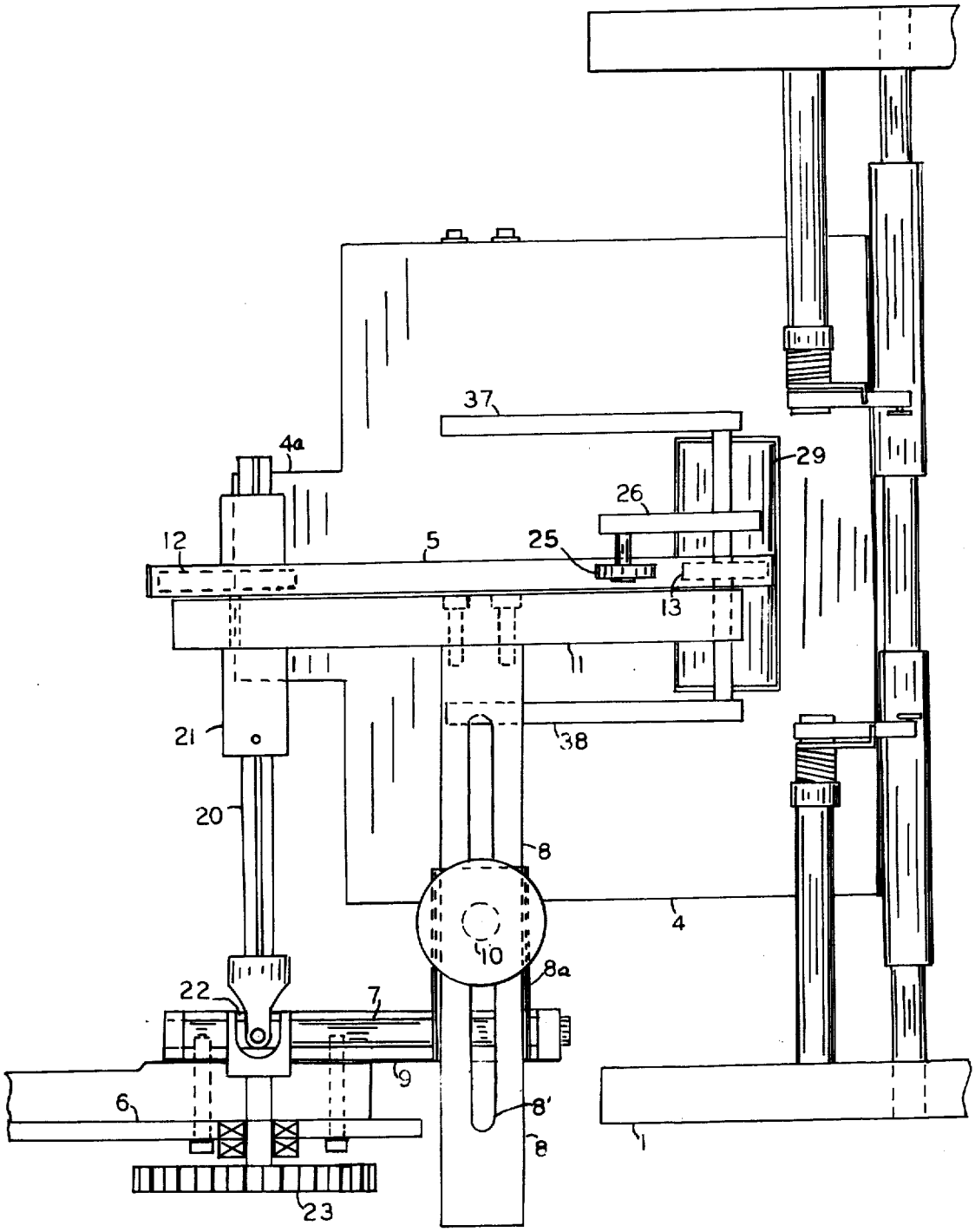
FIG. 2 is a top view of FIG. 1.
Figure 3:
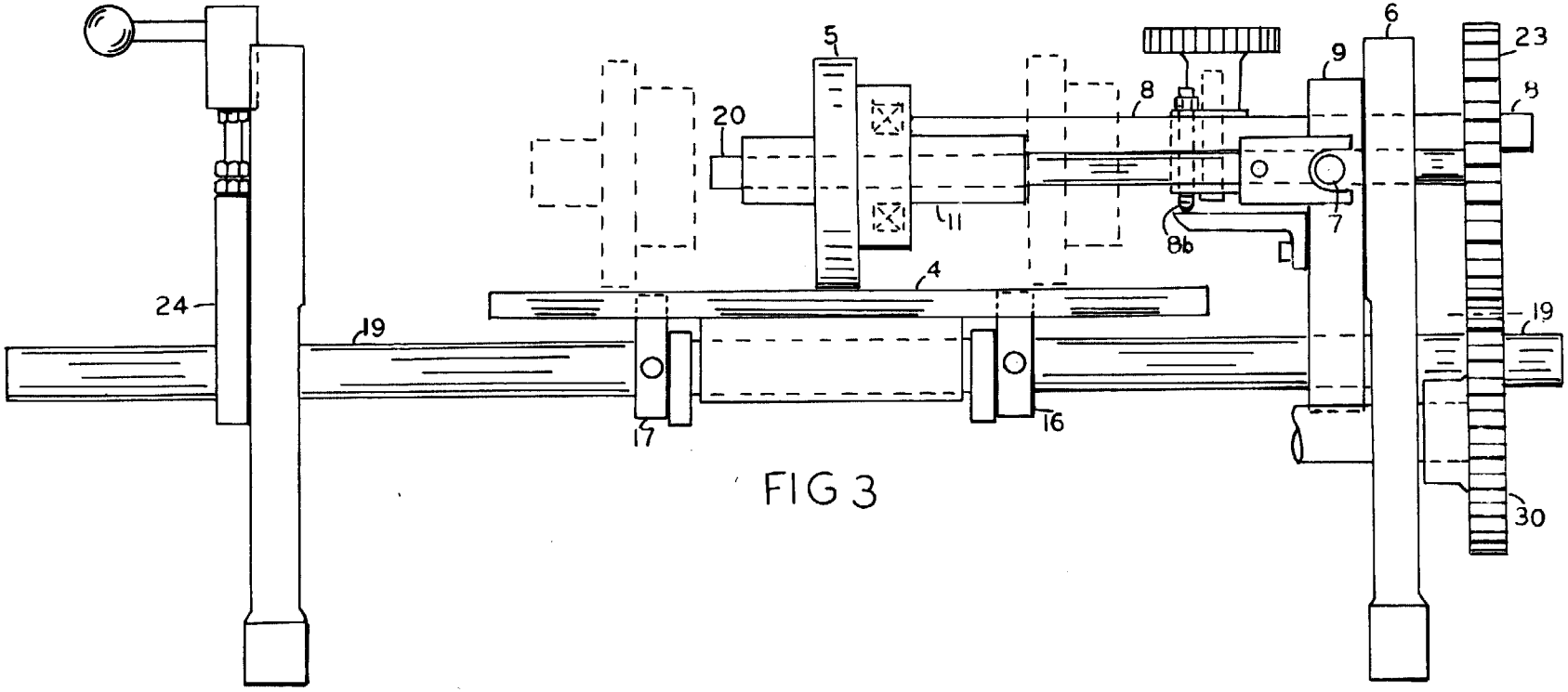
FIG. 3 is a front detail view.

It is desired to connect the two printing presses, 1 and 2 together for a continuous flow of work. The presses may be bolted together with a bolt 3 and the papers are transferred from the press 1 to the press 2 by means of the transfer mechanism of the invention. The transfer device generally comprises a curved plate 4 and an endless belt 5, which rides on the top of the curved plate. The entire belt assembly is pivotally mounted so that it may be rotated up and out of the way to permit the presses to be serviced.

More particularly and referring to the drawings, the belt assembly is mounted on a support member 9, which is bolted to the frame 6, of the printing press 2. A shaft 7, extends through the member 9, to provide for rotation of the belt assembly. Block member **8*a* is pivotally mounted on shaft 7. A slide member 8 is slidable mounted on the member 8*a*, which is pivotally mounted on shaft 7. Member 8, contains a slot 8', through wich a clamping member 10, extends into member 8*a*. Screw 8*b*, in block 8*a***, is a leveling screw.

On the end of the member 8, is mounted a cross member 11. Mounted on the cross member 11, is a roller 12, and a roller 13, which carry the belt 5. The curved plate 4, is mounted on the rotatably adjustable shaft 19, by means of collars 16, 17. Idler roller 29, is mounted in an opening in plate 4. Leaf springs 37, 38 are paper guides.

The roller 12, is mounted on a spline shaft 20, by means of the spline collar 21, for lateral adjustment of roller 12. The shaft 20, is connected to a universal joint 22, so that the assembly may be tilted up while the shaft 20, remains connected to be driven by means of the driven gear 23.

The belt 5, is held under tension by the roller 25, which rides on top of the belt 5. The roller 25, is mounted on the arm 26, which is pivotally mounted on the axis of the roller 13.

The assembly, including the endless belt 15, is laterally adjustable along slotted slide member 8. To adjust the assembly laterally, the clamp 10, is loosened and the assembly is pushed. The plate 4, has an extending tongue portion **4*a*, which fits between the chain sprockets of press 2**.

The curved plate 4 is smooth to minimize the friction between the papers and the plate. The belt 5, is of a high friction material such as rubberized material to provide relatively good friction between the belt and the papers. The curved plate 4, is tiltably mounted on shaft 19. Once the adjustment has been made, for best operation, the plate is locked into position by means of the clamp 24.

The shaft 20, of roller 12, mounts a gear 23, which meshes with driven gear 30, of press 2. Both presses are preferably driven by a single motor to make the linear paper feed speed equal. The belt driving gearing is chosen to match the linear speed of the belt with the linear paper feed speed of the presses.

Referring to FIGS. 4 and 4A, the block member **8*a* is rotatably mounted on the shaft 7. The slotted slide member 8**, is slidably mounted in a groove in the top of block member 8a. The slotted slide member 8, is clamped by means of the clamp 10, in the desired position. The screw 8b, mounted in the block 8a, is a leveling screw.

In operation, the papers are fed between the rollers 13 and 28, from the press 1, and inserted between the belt 5, and the curved plate 4. They are then carried by the belt over to the input of press number 2, where they are inserted in front of the pushers 31 and 31', of press 2, for further processing, such as numbering.

We claim:

1. Means to connect first and second printing press frames in tandem comprising, first and second support members mounted on a first printing press frame, a curved plate mounted on said first support member, said plate bridging the gap between an output of a first printing press and the input of a second printing press, an endless belt mounted on said second support member over said curved plate and running in contact with said curved plate, means connected to adjustably bolt the first and second printing press frames together, means connected to one of the printing press frames to drive the belt at substantially the same linear speed as the linear paper feed speed of the printing presses, whereby papers are delivered from one printing press and inserted between the belt and the plate and delivered to the other printing press, the second support member being pivotally mounted so that the belt assembly may be rotated out of the way for servicing the apparatus, means connected to the belt to adjust the belt laterally with respect to the printing presses, and means connected to the curved plate to tilt the curved plate.

* * * * *